US006596673B1

(12) United States Patent
Bovington et al.

(10) Patent No.: US 6,596,673 B1
(45) Date of Patent: Jul. 22, 2003

(54) MARINE DIESEL CYLINDER LUBRICATION

(75) Inventors: Charles H. Bovington, Oxfordshire (GB); Terence Garner, Oxfordshire (GB)

(73) Assignee: Infineum International Ltd. (GB)

( * ) Notice: Subject to any disclaimer, the term of this patent is extended or adjusted under 35 U.S.C. 154(b) by 0 days.

(21) Appl. No.: 09/648,885

(22) Filed: Aug. 25, 2000

(30) Foreign Application Priority Data

Sep. 13, 1999 (EP) ..... 99203006

(51) Int. Cl.[7] ..... C10M 141/12

(52) U.S. Cl. ..... 508/437; 508/436; 508/460; 508/572

(58) Field of Search ..... 508/437, 436, 508/460, 572

(56) References Cited

U.S. PATENT DOCUMENTS 5,792,735 A 8/1998 Cook et al. ..... 508/452
6,096,695 A * 8/2000 Lam et al.
6,103,672 A * 8/2000 Dunn et al.
6,153,565 A * 11/2000 Skinner et al.

FOREIGN PATENT DOCUMENTS

| | | | |
|---|---|---|---|
| EP | 0 369 804 A1 | 5/1990 | ..... C10M/141/10 |
| EP | 0 839 894 A1 | 5/1998 | ..... C10M/163/00 |
| WO | WO99/35218 | 7/1999 | ..... C10M/163/00 |

* cited by examiner

*Primary Examiner*—Jerry D. Johnson

(57) ABSTRACT

The cylinders of a two-stroke cross-head marine diesel engine characterised by a power output of 4,000 kW per cylinder or greater are lubricated by a cylinder lubricant comprising a basestock of lubricating viscosity, on over-based metal detergent and an oil-soluble sulfur-containing compound or phosphorus-containing compound, thereby to raise the onset temperature of scuffing-type mechanical wear of the cylinder walls.

3 Claims, 3 Drawing Sheets

Figure 1:
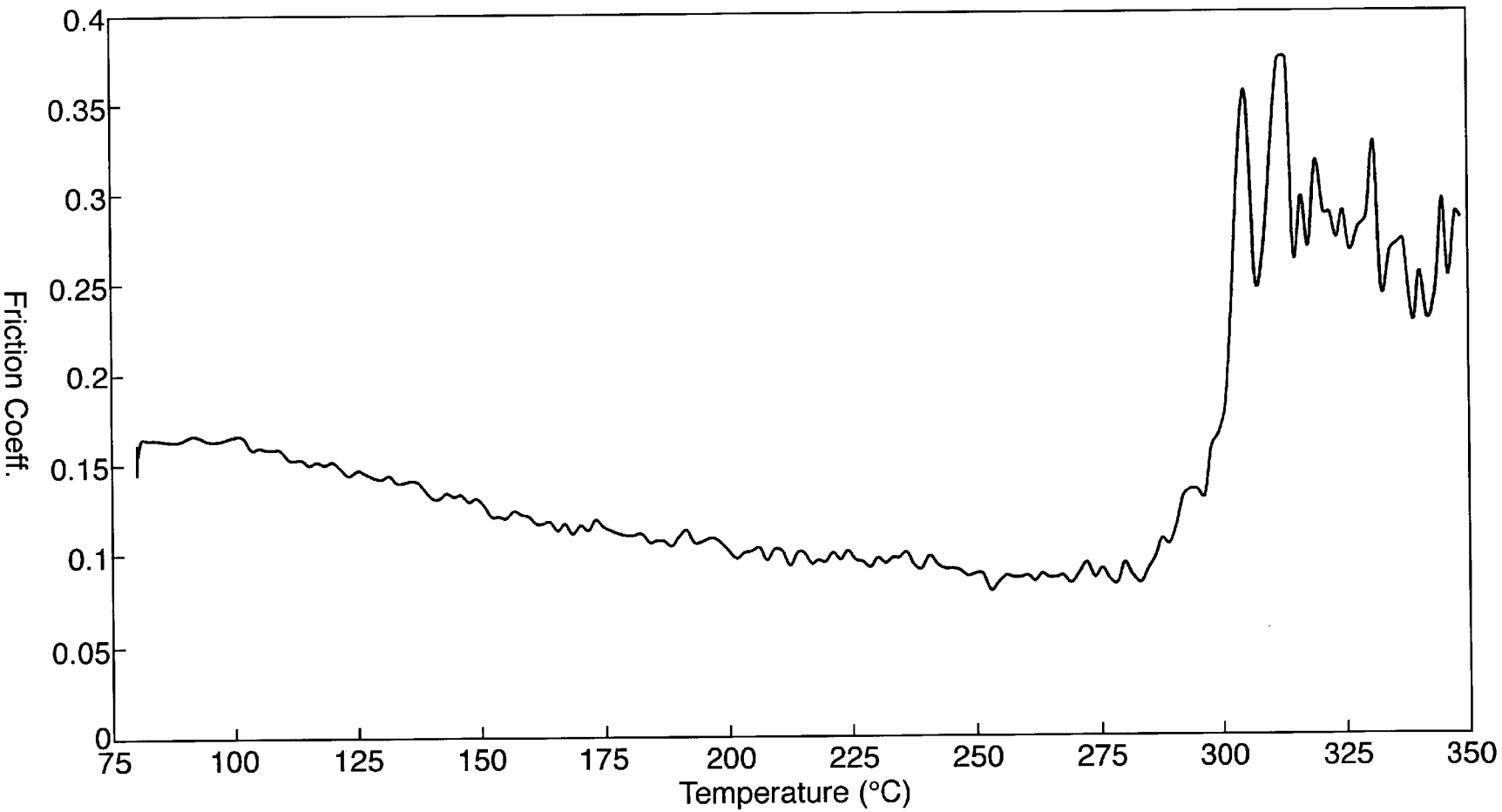

Friction Coeff.
0.4
0.35
0.3
0.25
0.2
0.15
0.1
0.05
0
75
100
125
150
175
200
225
250
275
300
325
350
Temperature (°C)

MARINE DIESEL CYLINDER LUBRICATION

This invention relates to the lubrication of the cylinder or cylinders of a cross-head marine diesel (compression-ignited) engine for raising the temperature of the onset of scuffing-type mechanical wear of the cylinder walls of the engine during its operation.

One type of marine diesel propulsion engine is characterised as a slow speed, two-stroke engine which is frequently referred to as a cross-head engine because of its construction. The firing cylinder and crankcase are lubricated separately by cylinder and system oils respectively. The cylinder oil, sometimes referred to as a marine diesel cylinder lubricant (MDCL), is fed to the internal walls of the cylinder by injection and, unlike the system or crankcase oil, is consumed.

"The Motor Ship", May 1999 pages 27–33, reports the emergence of a new generation of large bore cross-head marine diesel engines, the cylinders of which are subjected to higher gas pressures and temperatures then hitherto in order to improve engine efficiency. The article states that this has given rise to 'disastrous' instance of scuffing, that is to say adhesive wear of the internal walls of the cylinder, for example defined by cylinder liners, due to thinning of the lubricant film between the piston and the wall under the above-mentioned conditions.

The phenomenon of "scuffing" is approached when the lubricant becomes so thin that its thickness is similar to the height of the microscopic roughness (or asperities) on the opposing surfaces to be lubricated. Further thinning of the lubricant gives rise to actual solid/solid contact between opposing surfaces. When solid/solid interactions occur between asperities, they tend to adhere and give rise to so-called "adhesive friction". The stresses on the asperities are sufficient to remove material, which material loss is called "adhesive wear" or "scuffing".

The present invention ameliorates the above problem, as evidenced by test results described in this specification, by lubricating the cylinder with an MDCL that includes a specific auxiliary additive.

Thus, in a first aspect, the invention is a combination of a cylinder of a two-stroke cross-head marine diesel engine with a cylinder lubricant comprising, or made by admixing:

(A) a base stock of lubricating viscosity, in a major amount;

(B) at least one overbased metal detergent, in a minor amount; and (B) at least one auxiliary, preferably ashless or non-metal-containing, additive component, in a minor amount, and that is different from (B), comprising:

(C1) an oil-soluble sulfur-containing compound, and/or (C2) an oil-soluble phosphorus-containing compound, wherein the cylinder is characterised by a power output of 4000 or greater, such as 4200 or greater, preferably 4500 or greater, more preferably in the range of 4500 to 6000, kW. The bore of the cylinder may, for example, be 850 or greater, such as 900 or greater, preferably in the range of 900 to 1000, cm.

A second aspect of the invention is a method of lubricating a cylinder of a two-stroke cross-head marine diesel engine which comprises supplying to the walls of the cylinder, a cylinder lubricant as defined in the first aspect of the invention, wherein the cylinder is defined as in the first aspect of the invention.

A third aspect of the invention is a method of raising the temperature of the onset of scuffing-type mechanical wear of the walls of a cylinder of a two-stroke cross-head marine diesel engine by lubricating the walls with a cylinder lubricant as defined in the first aspect of the invention, wherein the cylinder is as defined in the first aspect of the invention.

In this specification, the following words and expressions shall have the meanings ascribed below:

"major amount"—in excess of 50 mass % of the lubricant;

"minor amount"—less that 50 mass % of the lubricant, both in respect of the stated additive and in respect of the total mass % of all the additives present in the lubricant, reckoned as active ingredient of the additive or additives;

"active ingredient (a.i.)" refers to additive material that is not diluent,

"comprises or comprising, or cognate words"—specifies the presence of stated features, steps, integers or components, but does not preclude the presence or addition of one or more other features, steps, integers, components, or groups thereof;

"TBN"—Total Base Numbers as measured by ASTM D2896;

"oil-soluble or oil-dispersible"—do not necessarily indicate solubility, dissolvability, miscibility or capability of suppression in oil in all proportions. They do mean, however, solubility or stable dispersibility sufficient to exert the intended effect in the environment in which the oil is employed. Moreover, additional incorporation of other additives may permit incorporation of higher levels of a particular additive, if desired;

it will be understood that the various components of the lubricant, essential as well as optimal and customary, may react under the conditions of formulation, storage or use and that the invention also provides the product obtainable or obtained as a result of any such reaction.

The features of the invention will now be discussed in more detail as follows:

Two Stroke Cross-Head Marine Diesel Engine

Certain characteristics of the engines of this invention and their cylinders have been indicated above. Further, the engines may, for example, have from 6 to 12 cylinders and their engine speed may, for example, be in the range of from 40 to 200, preferably 60 to 120, rpm. Their total output may, for example, be in the range of 18,000 to 70,000 kW.

Cylinder Lubricant

The lubricant may, for example have a TBN of 15 or greater, preferably, 40 or greater, for example in the range of from 60 to 100. Preferably, the viscosity index of the lubricant is at least 80, such as at least 90, for example at least 100.

The lubricant may, for example, have a kinematic viscosity at 100° C. (as measured by ASTM D445) of at least 14, preferably at least 15, more preferably in the range from 17 to 30, for example from 17 to 25, $mm^2s^{-1}$.

(A) Base Stock of Lubricating Viscosity

The base stock is an oil of lubricating viscosity (sometimes referred to as base oil) and may be any oil suitable for the lubrication of a cross-head engine. The lubricating oil may suitably be an animal, vegetable or a mineral oil. Suitably the lubricating oil is a petroleum derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example liquid polyisobutene and poly-alpha olefins. Commonly, a mineral oil is employed. The lubricating oil may generally comprise greater that 60, typically greater than 70%, by mass of the lubricant and typically have a kinematic viscosity at 100° C. of from 2 to 40, for example from 3 to 15, $mm^2s^{-1}$, and a viscosity index from 80 to 100, for example from 90 to 95.

Another class of lubricating oil is hydrocracked oils, where the refining process further breaks down the middle and heavy distillate fractions in the presence of hydrogen at high temperatures and moderate pressures. Hydrocracked oils typically have kinematic viscosity at 100° C. of from 2 to 40, for example from 3 to 15, $mm^2s^{-1}$ and a viscosity index typically in the range of from 100 to 110, for example from 105 to 108.

The term 'brightstock' as used herein refers to base oils which are solvent-extracted, de-asphalted products from vacuum residuum generally having a kinematic viscosity at 100° C. from 28 to 36 $mm^2s^{-1}$ and are typically used in a proportion of less that 30, preferably less than 20, more preferably less than 15, most preferably less than 10, such as less than 5, mass %, based on the mass of the lubricant.

(B) Overbased Metal Detergent

Overbased metal compounds suitable for use in the lubricant of the present invention include alkali metal and alkaline earth metal additives such as overbased oil-soluble or oil-dispersible calcium, magnesium, sodium or barium salts of a surfactant selected from phenol, sulfonic acid, carboxylic acid, salicylic acid and naphthenic acid, wherein the overbasing is provided by an oil-insoluble salt of the metal, e.g. carbonate, basic carbonate, acetate, formate, hydroxide or oxalate, which is stabilised by the oil-soluble salt of the surfactant. The metal of the oil-soluble surfactant salt may be the same or different from that of the metal of the oil-insoluble salt. Preferably the metal, whether the metal of the oil-soluble or oil-insoluble salt, is calcium.

Preferably, the TBN of the or each of the overbased metal compounds is at least 250, such as up to 500.

Surfactants for the surfactant system of the overbased metal compounds preferably contain at least one hydrocarbyl group, for example, as a substituent on an aromatic ring. The term "hydrocarbyl" as used herein means that the group concerned is primarily composed of hydrogen and carbon atoms and is bonded to the remainder of the molecule via a carbon atom but does not exclude the presence of other atoms or groups in a proportion insufficient to detract from the substantially hydrocarbon characteristics of the group. Advantageously, hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impart the desired oil-solubility.

Phenols, for use in this invention, may be non-sulfurized or, preferably, sulfurized. Further, the term "phenol" as used herein includes phenols containing more than one hydroxyl group (for example, alkyl catechols) or fused aromatic rings (for example, alkyl naphthols) and phenols which have been modified by chemical reaction, for example, alkylene-bridged phenols and Mannich base-condensed phenols; and saligenin-type phenols (produced by the reaction of a phenol and an aldehyde under basic conditions).

Preferred phenols may be derived from the formula

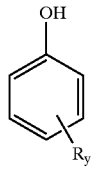

where R represents a hydrocarbyl group and y represents 1 to 4. Where y is greater than 1, the hydrocarbyl groups may be the same or different.

The phenols are frequently used in sulfurized form. Sulfurized hydrocarbyl phenols may typically be represented by the formula:

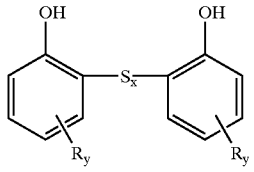

where x is generally from 1 to 4. In some cases, more than two phenol molecules may be linked by $S_x$ bridges.

In the above formulae, hydrocarbyl groups represented by R are advantageously alkyl groups, which advantageously contain 5 to 100, preferably 5 to 40, especially 9 to 12, carbon atoms, the average number of carbon atoms in all of the R groups being at least 9 in order to ensure adequate solubility in oil. Preferred alkyl groups are nonyl (tripropylene) groups.

In the following discussion, hydrocarbyl-substituted phenols will for convenience be referred to as alkyl phenols.

A sulfurizing agent for use in preparing a sulfurized phenol or phenate may be any compound or element which introduces —$(S)_x$— bridging groups between the alkyl phenol monomer groups, wherein x is generally from 1 to about 4. Thus, the reaction may be conducted with elemental sulfur or a halide thereof, for example, sulfur dichloride or, more preferably, sulfur monochloride. If elemental sulfur is used, the sulfurization reaction may be effected by heating the alkyl phenol compound at from 50 to 250, preferably at least 100° C. The use of elemental sulfur will typically yield a mixture of bridging groups —$(S)_x$— as described above. If a sulfur halide is used, the sulfurization reaction may be effected by treating the alkyl phenol at from −10 to 120, preferably at least 60° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulphurizing agent.

Where elemental sulfur is used as the sulfurizing agent, it may be desirable to use a basic catalyst, for example, sodium hydroxide or an organic amine, preferably a heterocyclic amine (e.g., morpholine).

Details of sulfurization processes are well known to those skilled in the art.

Regardless of the manner in which they are prepared, sulfurized alkyl phenols useful in preparing overbased metal compounds generally comprise diluent and unreacted alkyl phenols and generally contain from 2 to 20, preferably 4 to 14, and most preferably 6 to 12, mass % sulfur based on the mass of the sulfurized alkyl phenol.

As indicated above, the term "phenol" as used herein includes phenols which have been modified by chemical reaction with, for example, an aldehyde, and Mannich base-condensed phenols.

Aldehydes with which phenols may be modified include, for example, formaldehyde, propionaldehyde and butyraldehyde. The preferred aldehyde is formaldehyde. Aldehyde-modified phenols suitable for use are described in, for example, U.S. Pat. No. 5,259,967.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above provided that such substituents do not detract significantly from the surfactant properties of the phenols. Examples of such substituents are methoxy groups and halogen atoms.

Salicylic acids used in accordance with the invention may be non-sulfurized or sulfurized, and may be chemically modified and/or contain additional substituents, for example, as discussed above for phenols. Processes similar to those described above may also be used for sulfurizing a hydrocarbyl-substituted salicylic acid, and are well known to those skilled in the art. Salicylic acids are typically prepared by the carboxylation, by the Kolbe-Schmitt process, of phenoxides, and in that case, will generally be obtained (normally in a diluent) in admixture with uncarboxylated phenol.

Preferred substituents in oil-soluble salicylic acids from which overbased detergents in accordance with the invention may be derived are the substituents represented by R in the above discussion of phenols. In alkyl-substituted salicylic acids, the alkyl groups advantageously contain 5 to 100, preferably 9 to 30, especially 14 to 20, carbon atoms.

Sulfonic acids used in accordance with the invention are typically obtained by sulfonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulphonic acids usually contain from 7 to 100 or more carbon atoms. They preferably contain from 16 to 80, or 12 to 40, carbon atoms per alkyl-substituted aromatic moiety, depending on the source from which they are obtained.

When neutralizing these alkylaryl sulfonic acids to provide sulfonates, hydrocarbon solvents and/or diluent oils may also be included in the reaction mixture, as well as promoters and viscosity control agents.

Another type of sulfonic acid which may be used in accordance with the invention comprises alkyl phenol sulfonic acids. Such sulfonic acids can be sulfurized. Whether sulfurized or non-sulfurized these sulfonic acids are believed to have surfactant properties comparable to those of sulfonic acids, rather than surfactant properties comparable to those of phenols.

Sulfonic acids suitable for use in accordance with the invention also include alkyl sulfonic acids, such as alkenyl sulfonic acids. In such compounds the alkyl group suitably contains 9 to 100, advantageously 12 to 80, especially 16 to 60, carbon atoms.

Carboxylic acids which may be used in accordance with the invention include mono-and dicarboxylic acids. Preferred monocarboxylic acids are those containing 1 to 30, especially 8 to 24, carbon atoms. (Where this specification indicates the number of carbon atoms in a carboxylic acid, the carbon atom(s) in the carboxylic group(s) is/are included in that number.) Examples of monocarboxylic acids are iso-octanoic acid, stearic acid, oleic acid, palmitic acid and behenic acid. Iso-octanoic acid may, if desired, be used in the form of the mixture of $C_8$ acid isomers sold by Exxon Chemicals under the trade name "Cekanoic". Other suitable acids are those with tertiary substitution at the $\alpha$-carbon atom and dicarboxylic acids with more than 2 carbon atoms separating the carboxylic groups. Further, dicarboxylic acids with more than 35, for example, 36 to 100, carbon atoms are also suitable. Unsaturated carboxylic acids can be sulphurized. Although salicylic acids contain a carboxylic group, for the purposes of the present invention they are considered to be a separate group of surfactants, and are not considered to be carboxylic acid surfactants. (Nor, although they contain a hydroxyl group, are they considered to be phenol surfactants.)

Examples of other surfactants which may be used in accordance with the invention include the following compounds, and derivatives thereof: naphthenic acids, especially naphthenic acids containing one or more alkyl groups, dialkylphosphonic acids, dialkylthiophosphonic acids, and dialkyldithiophosphoric acids, high molecular weight (preferably ethoxylated) alcohols, dithiocarbamic acids, thiophosphines, and dispersants. Surfactants of these types are well known to those skilled in the art. Surfactants of the hydrocarbyl-substituted carboxylalkylene-linked phenol type, or dihydrocarbyl esters of alkylene dicarboxylic acids, the alkylene group being substituted with a hydroxy group and an additional carboxylic acid group, or alkylene-linked polyaromatic molecules, the aromatic moieties whereof comprise at least one hydrocarbyl-substituted phenol and at least one carboxy phenol, may also be suitable for use in the present invention; such surfactants are described in EP-A-708 171.

Further examples of detergents useful in the present invention are optionally sulfurized alkaline earth metal hydrocarbyl phenates that have been modified by carboxylic acids such as stearic acid, for examples as described in EP-A-271 262 (LZ-Adibis); and phenolates as described in EP-A-750 659 (Chevron).

Also suitable for use in the present invention are overbased metal compounds, preferably overbased calcium detergents, that contain at least two surfactant groups, such as phenol, sulfonic acid, carboxylic acid, salicylic acid and naphthenic acid, that may be obtained by manufacture of a hybrid material in which two or more different surfactant groups are incorporated during the overbasing process.

Examples of hybrid materials are an overbased calcium salt of surfactants phenol and sulfonic acid; an overbased calcium salt of surfactants phenol and carboxylic acid; an overbased calcium salt of surfactants phenol, sulfonic acid and salicylic acid; and an overbased calcium salt of surfactants phenol and salicylic acid.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80, more typically at least 90, for example at least 95, mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Preferably, the TBN of the overbased calcium detergent is at least 330, such as at least 350, more preferably at least 400, most preferably in the range of from 400 to 600, such as up to 500.

In the instance where at least two overbased metal compounds are present, any suitable proportions by mass may be used, preferably the mass to mass proportion of any one overbased metal compound to any other metal overbased compound is in the range of from 5:95 to 95:5; such as from 90:10 to 10:90; more preferably from 20:80 to 80:20; especially from 70:30 to 30:70; advantageously from 60:40 to 40:60.

Particular examples of hybrid materials include, for example, those described in WO-A-97/46643; WO-A-97/46644; WO-A-97/46645; WO-A-97/46646; and WO-A-97/46647.

Typically, the amount of overbased metal compound in the lubricant is at least 0.5, particularly in the range of from 0.5 to 20, such as from 3 to 12 or 2 to 7, mass % based on active ingredient per mass of lubricant.

The overbased metal compounds of the present invention may be borated, and typically the boron contributing compound, e.g the metal borate, is considered to form part of the overbasing. In the instance where a borated overbased metal compound is used in the present invention, the use of a borated dispersant and/or an oil-soluble or oil-dispersible boron compound may, or may not, be necessary provided the lubricant composition comprising the borated overbased metal compound has a viscosity index and TBN as defined herein. For the purpose of avoidance of doubt, non-borated dispersants are not excluded in the present invention in combination with a borated overbased metal compound.

Preferably, additives a) and b) are discrete molecules, but additives a) and b) may, if required, be consolidated into a single molecule, for example a borated overbased metal detergent.

(C) Auxiliary Additive Component

As stated, such components are preferably "ashless" by which is meant that it is a non-metallic organic material that forms substantially no ash on combustion, in contrast to metal-containing and hence, ash forming compounds.

As examples of such compounds, there may be mentioned oil-soluble sulfurized organic compounds such as sulfurized alkylphenols, phosphorosulfurized or sulfurized hydrocarbons, and sulfides of oils, fats of polyolefins, in which a sulfur group having two or more sulfur atoms is adjoined and bounded together in a molecular structure. Examples include sulfurized sperm oil, sulfurized pinene oil, sulfurized soybean oil, sulfurized polyolefin, sulfurized esters, dialkyl disulfide, dialkyl polysulfide, dibenzyl disulfide, ditertiary butyl disulfide, polyolefin polysulfide, and thiadiazole type compounds such as bis-alkyl polysulfide thiadiazole. Such compounds fall within the components (C1) according to the present invention.

Falling within the components (C2) according to the present invention are amine phosphates which include the neutralisation or partial neutralisation products of acidic phosphorus-containing intermediates and amines. The acidic intermediates are preferably formed from a hydroxy-substituted triester of a phosphorothioic acid with an inorganic phosphorus reagent selected from the group consisting of phosphorus acids, phosphorus oxides, and phosphorus halides. Thus, the amine phosphates may fall within the components (C2) according to the present invention such as in the form of amine dithiophosphates.

The hydroxy-substituted triesters of phosphorothioic acids include principally those having the structural formula

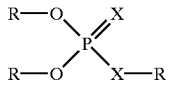

wherein R is selected from the class consisting of substantially hydrocarbon radicals and hydroxy-substituted substantially hydrocarbon radicals, at least one of the R radicals being a hydroxy-substituted substantially hydrocarbon radical, and X is selected from the class consisting of sulphur and oxygen, at least one of the X radicals being sulphur. The substantially hydrocarbon radicals include aromatic, aliphatic, and cycloaliphatic radicals such as aryl, alkyl, aralkyl, alkaryl, and cycloalkyl radicals. Such radicals may contain a polar substituent such as chloro, bromo, iodo, alkoxy, aryloxy, nitro, keto, or aldehydo group. In most instances there should be no more than one such polar group in a radical.

Specific examples of the substantially hydrocarbon radical are methyl, ethyl, isopropyl, secondary-butyl, isobutyl, n-pentyl, dodecyl, polyisobutene radical (molecular weight of 1500), cyclohexyl, cyclopentyl, 2-heptyl-cyclohexyl, phenyl, naphthyl, xenyl, p-heptylphenyl, 2,6-di-tertiary-butylphenyl, benzyl, phenylethyl, 3,5-dodecylphenyl, chlorophenyl, alpha-methoxy-beta-naphthyl, p-nitrophenyl, p-phenoxyphenyl, 2-bromomethyl, 3-chlorocyclohexyl, and polypropylene (molecular weight of 300)-substituted phenyl radical.

The hydroxy-substituted substantially hydrocarbon radicals include principally the above-illustrated substantially hydrocarbon radicals containing a hydroxy group. Those having less than 8 carbon atoms are preferred because of the convenience in preparing such hydroxy-substituted triesters. Examples of such radicals are hydroxymethyl, hydroxyethyl, 2-hydroxypropyl, 3-hydroxypropyl, 2-hydroxycyclohexyl, 2-hydroxycyclopentyl, 2-hydroxy-1-octyl, 1-hydroxy-3-octyl, 1-hydroxy-2-octyl, 2-hydroxy-3-phenyl-cyclohexyl, 1-hydroxy-2-phenylethyl, 2-hydroxy-1-phenylethyl, 2-hydroxy-1-p-tolylethyl, and 2-hydroxy-3-butyl radicals. Other hydroxy-substituted substantially hydrocarbon radicals are exemplified by 2,5-dihydroxyphenyl, alpha-hydroxy-beta-naphthyl, 3-hydroxy-4-dodecyl, 3-hydroxy-6-octadecyl, and p-(p-hydroxyphenyl)-phenyl radicals.

A preferred class of the hydroxy-substituted triesters comprises those having the structural formula

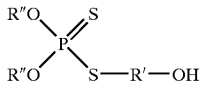

where R" is a substantially hydrocarbon radical illustrated above and R' is a bivalent substantially hydrocarbon radical such as alkylene or arylene radicals derived from the previously illustrated substantially hydrocarbon radicals. A convenient method for preparing such esters involves the reaction of a phosphorodithioic acid with an epoxide or a glycol. Such reaction is known in the art. The following equations are illustrative of the reaction.

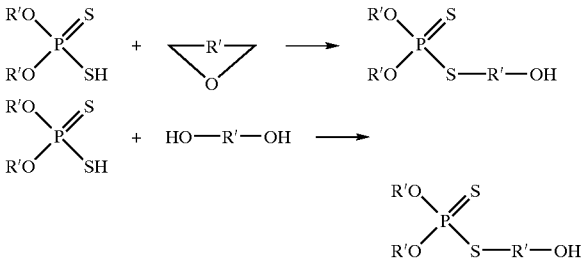

where

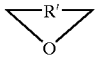

is an epoxide and HO—R'—OH is a glycol.

For reasons of economy, aliphatic epoxides having less than about 8 carbon atoms and styrene oxides are preferred for use in the above process. Especially useful epoxides are exemplified by ethylene oxide, propylene oxide, styrene oxide, alpha-methylstyrene oxide, p-methylstyrene oxide, cyclohexene oxide, cyclopentene oxide, dodecene oxide, octadecene oxide, 2,3-butene oxide, 1,2-butene oxide, 1,2-octene oxide, 3,4-pentene oxide, and 4-phenyl-1,2-cyclohexene oxide. Glycols include both aliphatic and aromatic di-hydroxy compounds. The latter are exemplified by hydroquinone, catechol, resorcinol, and 1,2-dihydroxynaphthalene. Aliphatic glycols are especially useful such as ethylene glycol, trimethylene glycol, tetramethylene glycol, decamethylene glycol, di-ethylene glycol, triethylene glycol, and pentaethylene glycol.

Another convenient method for preparing the hydroxy-substituted triesters comprises the addition of a phosphorodithioic acid to an unsaturated alcohol such as allyl alcohol, cinnamyl alcohol, or oleyl alcohol such as is described in U.S. Pat. No. 2,528,723. Still another method involves the reaction of a metal phosphorothiate with a halogen-substituted alcohol described in U.S. RE. Pat. No. 20,411.

The phosphorodithioic acids from which the hydroxy-substituted triesters can be derived are likewise well-known. They are prepared by the reaction of phosphorus pentasulfide with an alcohol or a phenol. The reaction involves 4 moles of the alcohol or phenol per mole of phosphorus pentasulfide and may be carried out within the temperature range from about 50° C. to 200° C. Thus, the preparation of O,O'-di-n-hexylphosphorodithioic acid involves the reaction of phosphorus pentasulfide with 4 moles of n-hexyl alcohol at 100° C. for 2 hours. Hydrogen sulfide is liberated and the residue is the defined acid. The preparation of the phosphoromonothioic acid may be effected by treatment of corresponding phosphorodithioic acid with steam. Phosphorotrithioic acids and phosphorotetrathioic acids can be obtained by the reaction of phosphorus pentasulfide with mercaptans or mixtures of mercaptans and alcohols.

The reaction of phosphorus pentasulfide with a mixture of phenols or alcohols (e.g., isobutanol and n-hexanol in 2:1 weight ratio) results in phosphorodithioic acids in which the two organic radicals are different. Such acids likewise are useful herein.

The inorganic phosphorus reagent useful in the reaction with the hydroxy-substituted triesters of phosphorothioic acids is preferably phosphorus pentoxide. Other phosphorus oxides such as phosphorus trioxide and phosphorus tetroxide likewise are useful. Also useful are phosphorus acids, and phosphorus halides. They are exemplified by phosphoric acid, pyrophosphoric acid, metaphosphoric acid, hypophosphoric acid, phosphorous acid, pyrophosphorous acid, metaphosphorous acid, hypophosphorous acid, phosphorous trichloride, phosphorus tribromide, phosphorous pentachloride, monobromophosphorus tetrachloride, phosphorus oxychloride, and phosphorus triiodide.

The reaction of the hydroxy-substituted triesters of phosphorothioic acids with the inorganic phosphorus reagent results in an acidic product. The chemical constitution of the acidic product depends to a large measure on the nature of the inorganic phosphorus reagent used. In most instances the product is a complex mixture the precise composition of which is not known. It is known, however, that the reaction involves the hydroxy radical of the triester with the inorganic phosphorus reagent. In this respect the reaction may be likened to that of an alcohol or a phenol with the inorganic phosphorus reagent. Thus, the reaction of the hydroxy-substituted triester with phosphorus pentoxide is believed to result principally in acidic phosphates, i.e., mono- or di-esters of phosphoric acid in which the ester radical is the residue obtained by the removal of the hydroxy radical of the phosphorothioic triester reactant. The product may also contain phosphonic acids and phosphinic acids in which one or two direct carbon-to-phosphorus linkages are present.

The acidic product of the reaction between the hydroxy-substituted triester with phosphorus oxyhalide or phosphoric acid is believed to result in similar mixtures of acidic phosphates, phosphonic acids, and/or phosphinic acids. On the other hand, the reaction of the hydroxy-substituted triester with phosphorus trichloride or phosphorus acid is believed to result principally in acidic organic phosphites. Still other products may be obtained from the use of other inorganic phosphorus reagents illustrated previously. In any event, the product is acidic and as such is useful as the intermediate for the preparation of the neutralized products useful in invention.

Usually, from 2 moles to 5 moles of the triester is used for each mole of the inorganic phosphorus reagent. The preferred proportion of the triester is about 3–4 moles for each mole of the phosphorus reagent. The use of amounts of either reactant outside the limits indicated here results in excessive unused amounts of the reactant and is ordinarily not preferred.

The reaction of the hydroxy-substituted triester with the inorganic phosphorus reagent to produce the acidic intermediate can be effected simply by mixing the two reactant at a temperature above about room temperature, preferably above 50° C. A higher temperature such as 100° C. or 150° C. may be used but ordinarily is unnecessary.

The amines useful for neutralizing the acidic intermediate may be aliphatic amines, aromatic amines, cycloaliphatic amines, heterocyclic amines, or carbocyclic amines. Amines having from 4 to 30 aliphatic carbon atoms are preferred and aliphatic primary amines containing at least 8 carbon atoms and having the formula, R"—$NH_2$, where R" is, for example, an aliphatic radical such as tert-octyl, tert-dodecyl, tert-tetradecyl, tert-octadecyl, cetyl, behenyl, stearyl, eicosyl, docosyl, tetracosyl, hexatriacontanyl, and pentahexacontanyl, are especially useful. Examples of other aliphatic amines include cyclohexyl amine, n-hexylamine, dodecylamine, di-dodecylamine, tridodecylamine, N-methyl-octylamine, butylamine, behenylamine, stearyl amine, oleyl amine, myristyl amine, and N-dodecyl trimethylene diamine, aniline, o-toluidine, benzidine, phenylene diamine, N,N'-di-sec-butylphenylene diamine, betanaphthylamine, alpha-naphthylamine, morpholine, piperazine, menthane diamine, cyclopentyl amine, ethylene diamine, hexamethylene tetramine, octamethylene diamine, and N,N'-dibutyl-phenylene diamine. Also useful are hydroxy-substituted amines such as ethanolamine, diethanolamine, triethanolamine, isopropanolamine, para-aminophenol, 4-amino-naphthol-1,8-amino-naphthol-1, beta-aminoalizarin, 2-amino-2-ethyl-1,3-propandiol, 4-amino-4'-hydroxy-diphenyl ether, 2-amino-resorcinol, etc.

Of the various available hydroxy-substituted amines which can be employed, a preference is expressed for hydroxy-substituted aliphatic amines, particularly those which conform for the most part to the formula

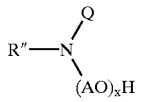

wherein R" is as previously defined; A is a lower alkylene radical such as methylene, ethylene, propylene-1,2, trimethylene, butylene-1,2, tetramethylene, amylene-1,3, pentamethylene, etc.; x is 1–10, inclusive; and Q is hydrogen, $(AO)_xH$, or R". The use of such hydroxy-substituted aliphatic amines in many instances imparts improved rust-inhibiting characteristics. Examples of such preferred hydroxy-substituted aliphatic amines include N-4-hydroxybutyl-dodecyl amine, N-2-hydroxyethyl-n-octylamine, N-2-hydroxypropyl dinonylamine, N,N-di-(3-hydroxypropyl)-tert-dodecyl amine, N-hydroxytrieth-oxyethyl-tert-tetradecyl amine, N-2-hydroxyethyl-tert-dodecyl amine, N-hydroxyhexa-propoxypropyl-tert-octadecyl amine, N-5-hydroxypentyl di-n-decyl amine, etc. A convenient and economical method for the preparation of such hydroxy-substituted aliphatic amines involves the known reaction of an aliphatic primary or secondary amine with at least about an equimolecular amount of an epoxide, preferably in the presence of a suitable catalyst such as sodium methoxide, sodamide, sodium metal, etc.

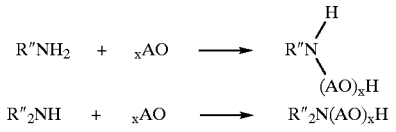

In the above formulae, R", x and A are as previously defined. A particular preference is expressed for N-monohydroxyalkyl substituted mono-tertiary-alkyl amines of the formula tert-R—NHAOH, wherein tert-R is a tertiary-alkyl radical containing from 11 to 24 carbon atoms. In lieu of a single compound of the formula tert-R—NHAOH, it is often convenient and desirable to use a mixture of such compounds prepared, for example, by the reaction of an epoxide such as ethylene oxide, propylene oxide, or butylene oxide with a commercial mixture of tertiary-alkyl primary amines such as $C_{11}$–$C_{14}$ tertiary-alkyl primary amines, $C_{13}$–$C_{22}$ tertiary-alkyl primary amines, etc.

The neutralization of the acidic intermediate with the amine is in most instances exothermic and can be carried out simply by mixing the reactants at ordinary temperatures, preferably from 0° C. to 200° C. The chemical constitution of the neutralized product of the reaction depends to a large extent upon the temperature.

Thus, at a relatively low temperature, such as less than 80° C., the product comprises predominantly a salt of the amine with the acid. At a temperature above 100° C., the product may contain amides, amidines, or mixtures thereof. However, the reaction of the acidic intermediate with a tertiary amine results only in a salt.

The relative proportions of the acidic intermediate and the amines used in the reaction are preferably such that a substantial portion of the acidic intermediate is neutralized. The lower limit as to the amount of amine used in the reaction is based primarily upon a considerable of the utility of the product formed. In most instances, enough amine should be used as to neutralize at least 50% of the acidity of the intermediate. For use as additives in hydrocarbon oils, substantially neutral products such as are obtained by neutralization of at least 90% of the acidity of the intermediate are desirable. Thus the amount of the amine used may vary within wide ranges depending upon the acidity desired in the product and also upon the acidity of the intermediate as determined by, for example, ASTM procedure designation D-664 or D-974.

A particularly preferred amine phosphate is when the acidic intermediate is derived from the reaction of $P_2O_5$ with hydroxypropyl O,O-di(4-methyl-2-pentyl) phosphorodithioate. This acidic intermediate may then be neutralised or partially neutralised with a $C_{12}$ to $C_{14}$ tertiary aliphatic primary amine. An example of such an amine may be commercially purchased under the trade name of Primene 81R.

Preferred are sulfurized alkylphenols such as those described above in connection with the preparation of overbased metal detergents for example present in the lubricant is an amount of at least 0.5, such as at least 1.5 or 2, for example up to 8, 10, 15 or 20 mass %, and amine dithiophosphates, for example present in the lubricant in an amount of at least 0.1, for example up to 10, such as in the range of 0.4 to 5, or 0.6 to 2, mass %.

Co-Additives

The lubricants may include an antiwear agent as a co-additive and may also contain other co-additives, for example, antioxidants, antifoaming agents and/or rust inhibitors. Further details of particular co-additives are as follows.

Oxidation inhibitors, or antioxidants, reduce the tendency of mineral oils to deteriorate in service, evidence of such deterioration being, for example, the production of varnish-like deposits on metal surfaces and of sludge, and viscosity increase. Suitable oxidation inhibitors include sulphurized alkyl phenols and alkali or alkaline earth metal salts thereof; diphenylamines; phenyl-naphthylamines; and phosphosulphurized or sulphurized hydrocarbons.

Other oxidation inhibitors or antioxidants which may be used in the lubricant comprise oil-soluble copper compounds. The copper may be blended therein as any suitable oil-soluble copper compound. By oil-soluble is meant that the compound is oil-soluble under normal blending conditions in the base stock or an additive package. The copper may, for example, be in the form of a copper dihydrocarbyl thio- or dithio-phosphate. Alternatively, the copper may be added as the copper salt of a synthetic or natural carboxylic acid, for example, a C8 to C18 fatty acid, an unsaturated acid, or a branched carboxylic acid. Also useful are oil-soluble copper dithiocarbamates, sulphonates, phenates, and acetylacetonates. Examples of particularly useful copper compounds are basic, neutral or acidic copper Cu I and/or Cu II salts derived from alkenyl succinic acids or anhydrides.

Additional detergents and metal rust inhibitors include the metal salts, which may be overbased and have a TBN less than 300, of sulphonic acids, alkyl phenols, sulphurized alkyl phenols, alkyl salicylic acids, thiophosphonic acids, naphthenic acids, and other oil-soluble mono- and dicarboxylic acids. Representative examples of detergents/rust inhibitors, and their methods of preparation, are given in EP-A-208 560. In the case of metal salts of salicylic acids, the TBN of the metal salts may be less than 200.

Antiwear agents, as their name implies, reduce wear of metal parts. Zinc dihydrocarbyl dithiophosphates (ZDDPs) are very widely used as antiwear agents. Especially preferred ZDDPs are those of the formula $Zn[SP(S)(OR_1)(OR_2)]_2$ wherein $R_1$ and $R_2$ represent hydrocarbyl groups such as alkyl groups that contain from 1 to 18, preferably 2 to 12, carbon atoms.

Pour point depressants otherwise known as lube oil flow improvers, lower the minimum temperature at which the fluid will flow or can be poured. Such additives are well known. Foam control may be provided by an antifoamant of the polysiloxane type, for example, silicone oil or polydimethyl siloxane.

Proportions

Typical proportions for additives for an MDCL (a marine diesel cylinder lubricant), additional to additives (C) of this invention, are as follows:

| Additive | Mass % a.i.* (Broad) | Mass % a.i.* (Preferred) |
|---|---|---|
| Detergent(s) | 1–40 | 2–27 (14–22 more preferred) |
| Dispersant(s) | 0–3 | 0–2 |
| Anti-wear agent(s) | 0–1.5 | 0–1.3 |
| Anti-oxident | 0–5 | 0–3 |
| Pour point depressant | 0–0.15 | 0–0.1 |
| Mineral or synthetic base oil | Balance | Balance |

*Mass % active ingredient based on the final oil.
Stabilisers and/or rust inhibitors may also be included.

When a plurality of additives is employed it may be desirable, although not essential, to prepare one or more additive packages or concentrates comprising the additives, whereby several additives can be added simultaneously to the base stock to form the lubricant. Dissolution of the additive package(s) into the base stock may be facilitated by solvents and by mixing accompanied with mild heating, but this is not essential. The additive package(s) will typically be formulated to contain the additive(s) in proper amounts to provide the desired concentration, and/or to carry out the intended function, in the final lubricant when the additive package(s) is/are combined with a predetermined amount of base stock. Thus, components (B) and (C) in accordance with the present invention may be admixed with small amounts of base stock or other compatible solvents together with other desirable additives to form additive packages containing active ingredients in an amount, based on the additive package, of, for example, from 2.5 to 90 and preferably from 5 to 75 and most preferably from 8 to 60, mass %, the remainder being base stock.

The final lubricant may typically contain about 5 to 40 mass % of the additive package(s), including diluent, the remainder being base stock.

EXAMPLES

The invention is illustrated by, but in no way limited to, the following examples, in which reference will be made to the accompanying drawings, identified as FIGS. 1, 2 and 3. Each FIGS. (1 to 3) represents, as the results of an HFRR test to be described below, a trace in graphical form where the x-axis represents temperature in ° C. and the y-axis represents coefficient of friction.

Components

The components used in the examples were as follows:

Overbased Metal Detergent $B_1$: an overbased calcium salicylate having a TBN of 281

Auxiliary Additive Component $C_1$: a sulfurized alkylphenol additive characterised by an a.i. of about 70% and a sulfur content of 6.4 mass %.

$C_2$ an amine dithiophosphate gear oil additive characterised by an a.i. of 75% and a phosphorus content of 7.2%, a sulfur content of 8.7%, and a nitrogen content of 1.2% (all mass).

Stabilisers $D_1$: a maleic anhydride substituted with a polyisobutene to give a polyisobutene succinic anhydride Basestock $A_1$: a paraffinic mineral oil also containing a brightstock.

Other components, as required, such as rust inhibitors were used.

Lubricants And Tests

A first sample of marine diesel cylinder lubricant was prepared by admixing with the basestock $A_1$, the detergent $B_1$ and the stabiliser $D_1$. This was a comparison sample and is designated as SAMPLE Z. Second and third samples of a marine diesel cylinder lubricant were prepared by admixing with the basestock $A_1$, the detergent $B_1$ and the stabiliser $D_1$, in the same proportions as in SAMPLE Z, and also compound $C_1$ (3 mass % based on the lubricant mass) in the second sample and compound $C_2$ (0.8 mass % based on the lubricant mass) in the third sample. The second and third samples are examples included in the invention and are designated as SAMPLES 1 and 2 respectively.

The admixing was carried out by blending the components and the basestock at 60° C. for one hour.

Each sample was tested in a High Frequency Reciprocating Rig (HFRR) whereby friction coefficient was measured as a function of temperature in the temperature range from 80 to 350° C. This test is designed to examine the ability of an oil to maintain lubrication at elevated temperatures. It involves lubricating a stationary specimen with the test oil while subjecting it to a moving specimen under an applied load. The temperature is steadily raised from 80 to 350° C. in 15 minutes. The moving specimen has a frequency of 20 HZ and an applied load of 400 g. Data are logged every 5 seconds.

RESULTS

Sample Z: the results are shown in FIG. 1, from which it is seen that the friction coefficient fell from about 0.16 at 75° C. to about 0.1 at around 200° C., and fell, less steeply, to about 0.08 at around 280° C. Above 280° C., the coefficient arose steeply to about 0.25 or above and remained on or about 0.25 up to 350° C.

Figure 2:
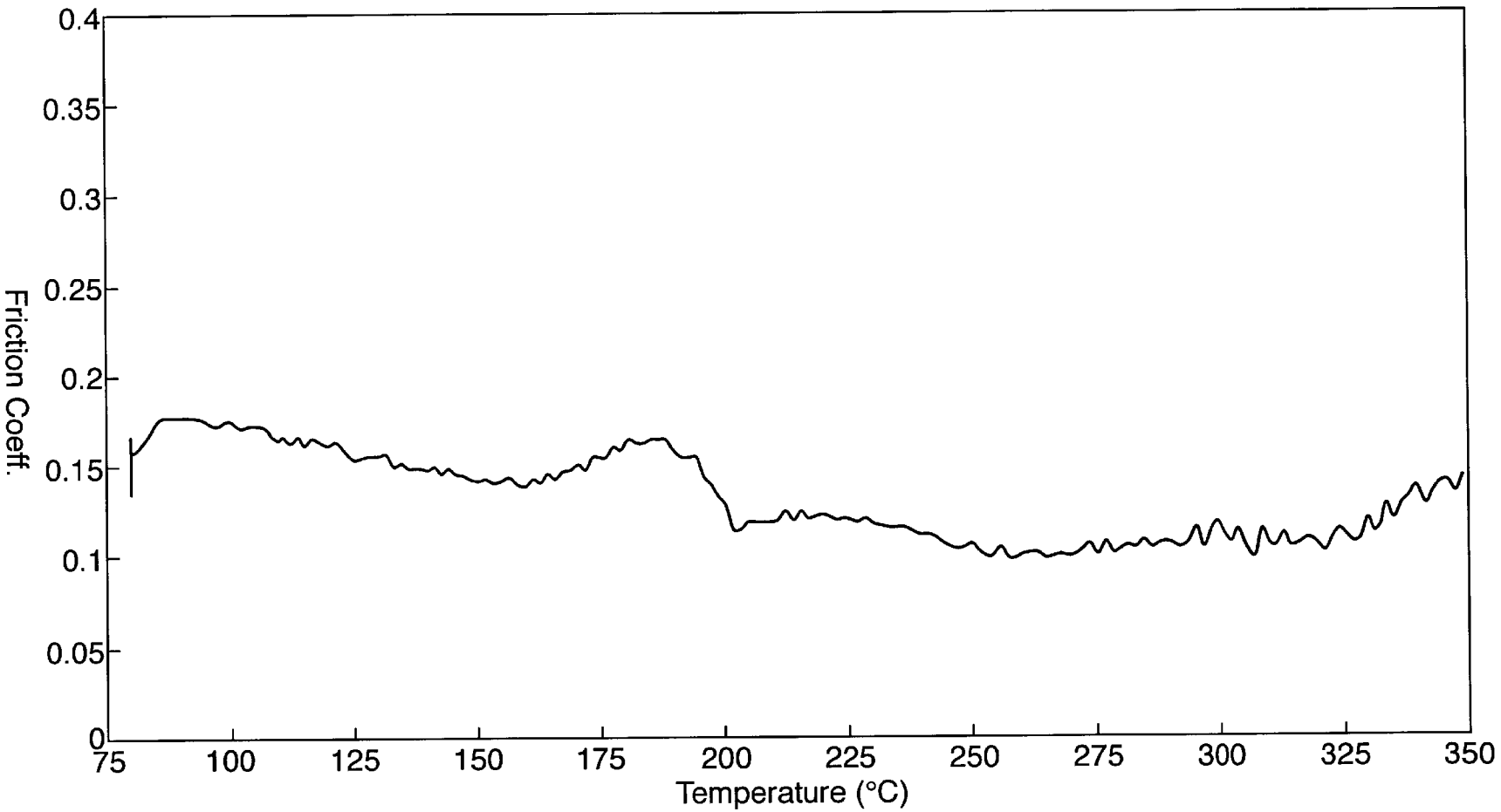

Sample 1: the results are shown in FIG. 2, from which it is seen that the friction coefficient remained on or about 0.15 from 75° C. to 190° C. and fell to about 0.1 at 200° C. It remained just above, or about, 0.1 from 200 to 325° C. The coefficient rose at 325 to 350° C., but not exceeding 0.15.

Figure 3:
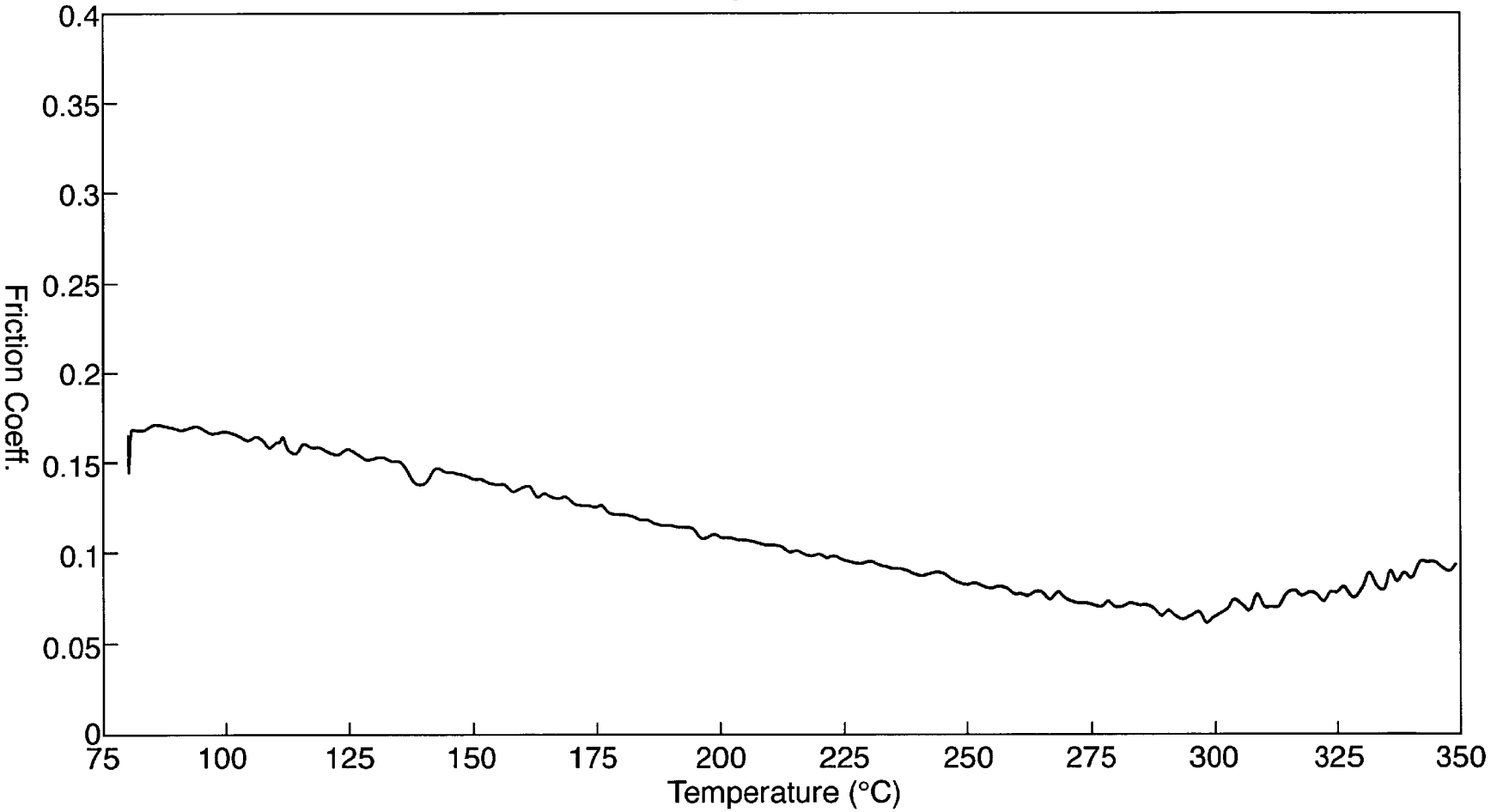

Sample 2: the results are shown in FIG. 3, from which it is seen that the friction coefficient fell steadily from 0.16 at 75° C. to about 0.06 at 300° C. From 325 to 350° C., it rose but was never greater that 0.1.

Since the liner walls of cylinders of cross-head engines included in this invention attain temperatures in excess of 270° C., the above test results are a clear indication of the efficiency of Samples 1 and 2 as lubricants thereof. Thus, they did not give rise to a significant increase in mechanical wear, as indicated by friction coefficient, at temperatures above 270° C.

What is claimed is:

1. A cylinder lubricant for lubricating a cylinder of a two-stroke cross-head marine diesel engine, said cylinder lubricant comprising, or made by admixing, (A) a base stock of lubricating viscosity, in a major amount;

(B) at least one overbased calcium salicylate detergent, in a minor amount;

(C) from about 0.4 to about 5 mass %, based on the total mass of the lubricant of at least one oil-soluble amine dithiophosphate comprising the neutralization, or partial neutralization product of an amine and an acidic intermediate comprising the reaction product of a triester of a phosphorothioic acid and an inorganic phosphorus reagent selected from the group consisting of phosphorus acids, phosphorus oxides and phosphorus halides.

2. A method of lubricating a cylinder of a two-stroke cross-head marine diesel engine which comprises supplying to the walls of the cylinder, a cylinder lubricant as defined in claim 1.

3. A method of raising the temperature of the onset of scuffing-type mechanical wear of the walls of a cylinder of a two-stroke cross-head marine diesel engine by lubricating the walls with a cylinder lubricant as defined in claim 1.

* * * * *